US012467219B2

(12) United States Patent
Cui

(10) Patent No.: US 12,467,219 B2
(45) Date of Patent: Nov. 11, 2025

(54) LIFTING AND REINFORCING PROCESS FOR DUST-FREE FACTORY FLOOR

(71) Applicant: BEIJING HENGXIANG HONGYE FOUNDATION REINFORCEMENT TECHNOLOGY CO., LTD., Beijing (CN)

(72) Inventor: Tengyue Cui, Beijing (CN)

(73) Assignee: BEIJING HENGXIANG HONGYE FOUNDATION REINFORCEMENT TECHNOLOGY CO., LTD., Beijing (CN)

( * ) Notice: Subject to any disclaimer, the term of this patent is extended or adjusted under 35 U.S.C. 154(b) by 74 days.

(21) Appl. No.: 18/675,310

(22) Filed: May 28, 2024

(65) Prior Publication Data

US 2024/0309601 A1 Sep. 19, 2024

Related U.S. Application Data

(63) Continuation of application No. PCT/CN2023/079305, filed on Mar. 2, 2023.

(30) Foreign Application Priority Data

Mar. 3, 2022 (CN) ..... 202210202116.8

(51) Int. Cl.
*E02D 3/12* (2006.01)
*E02D 35/00* (2006.01)

(52) U.S. Cl.
CPC ..... *E02D 35/005* (2013.01); *E02D 3/12* (2013.01)

(58) Field of Classification Search
CPC .... E02D 35/005; E02D 3/12; E02D 2250/003
See application file for complete search history.

(56) References Cited

U.S. PATENT DOCUMENTS 2,627,169 A * 2/1953 Poulter ..... E02D 35/00 405/267
6,634,831 B2 * 10/2003 Canteri ..... E02D 3/12 52/742.13

(Continued)

FOREIGN PATENT DOCUMENTS

CN 1908318 A 2/2007
CN 103233487 A 8/2013

(Continued)

OTHER PUBLICATIONS

International Search Report of corresponding International Patent Application No. PCT/CN2023/079305, mailed Jun. 9, 2023, 7 pages.

*Primary Examiner* — Benjamin F Fiorello
(74) *Attorney, Agent, or Firm* — Cooper Legal Group, LLC

(57) ABSTRACT

Disclosed in the present invention is a lifting and reinforcing process for a dust-free factory floor, including: reinforcing a soft foundation and precisely lifting a settlement range. Reinforcing a soft foundation includes: step 1: determining a depth of a soft soil layer in an inner settlement area of the factory, and designing a drilling curve; step 2: drilling guiding holes from the outer construction point of the factory; step 3: connecting and communicating grouting channels; and step 4: grouting. Lifting a settlement area includes: step 1: determining a depth range between the reinforced soft foundation and the floor, and designing the drilling curve; step 2: drilling the guiding holes; step 3: connecting and communicating the grouting channels; step 4: starting grouting; and step 5: stopping grouting.

8 Claims, 2 Drawing Sheets

(56) References Cited

U.S. PATENT DOCUMENTS

| | | | | |
|---|---|---|---|---|
| 10,760,236 | B2 * | 9/2020 | Eddie | G01N 33/24 |
| 10,961,682 | B1 * | 3/2021 | Williams | E02D 31/10 |
| 10,995,466 | B1 * | 5/2021 | Alrafaei | E21B 4/18 |
| 2016/0305076 | A1 * | 10/2016 | Doan | E04G 23/0203 |
| 2016/0362901 | A1 * | 12/2016 | Tabatabai | E04G 23/0203 |
| 2020/0299918 | A1 * | 9/2020 | Moody | E02D 3/12 |

FOREIGN PATENT DOCUMENTS

| | | | |
|---|---|---|---|
| CN | 108265720 | A | 7/2018 |
| CN | 113802424 | A | 12/2021 |
| CN | 113863279 | A | 12/2021 |
| CN | 114277776 | A | 4/2022 |
| JP | 2009249826 | A | 10/2009 |
| JP | 4803472 | B1 | 10/2011 |
| KR | 102112630 | B1 | 5/2020 |

* cited by examiner

LIFTING AND REINFORCING PROCESS FOR DUST-FREE FACTORY FLOOR

CROSS-REFERENCE TO RELATED APPLICATION

This application is a continuation of PCT application Ser. No. PCT/CN2023/079305, filed on Mar. 2, 2023, which claims the priority and benefit of Chinese patent application Ser. No. 202210202116.8, filed on Mar. 3, 2022. The entireties of PCT application Ser. No. PCT/CN2023/079305 and Chinese patent application Ser. No. 202210202116.8 are hereby incorporated by reference herein and made a part of this specification.

TECHNICAL FIELD

The present application relates to a process for lifting and reinforcing factory floor, and more particularly, to a process for accurately and horizontally lifting and reinforcing process for the dust-free factory floor, belonging to a technical field of factory lifting construction.

BACKGROUND ART

In various industrial factories, there is a dust-free factory. For the purpose of ensuring a dust-free effect, top plate, wall plate, and ground of the factory are all processed by using a special process. If there is a settlement of the factory due to foundation factor, it is necessary to drill holes and grout the ground by traditional drilling grouting machine. Even if the lifting is completed, the later-period grouting holes will be repaired.

However, during the construction, the possibility that external dust enters the factory by grouting holes, grouting channels or the repairing seal for repairing the grouting holes is significantly increased due to disturbance of the grouting device. If the settlement area is large or there are too many settlement points, the grouting device and the grouting holes are also accordingly increased, leading to increased connection area with the factory foundation soil. Since there is a fissure on the foundation soil itself or there is an underground water, the possibility of the grouting holes deep into the foundation soil, in communication with the fissure, and connecting to the underground water is further increased, thereby significantly increasing the dust entering the dust-free factory. The dust removal can be done again for the factory after the above action, however, increased cost can't be ignored.

SUMMARY

A purpose of the present application is to disclose a process for accurately horizontally lifting and reinforcing a dust-free factory floor for solving the above problem, which can ensure accurately lifting the floor, without causing damages to the factory.

The present application realizes above purpose by following solution: a process for accurately horizontally lifting and reinforcing the dust-free factory floor including:

step one, reinforcing a soft foundation, specifically including following steps:

step 1: determining a depth of a soft soil layer in an inner settlement area of the factory, and designing a drilling curve from an outer construction point of the factory to the inner settlement area of the factory;

step 2: drilling guiding holes from the outer construction point of the factory, so that the guiding holes lead to a designated location and a designated depth grouting point of the inner settlement area of the factory;

step 3: connecting and communicating grouting channels from the outer construction point of the factory to the inner grouting point of the factory with each other; and step 4: starting grouting from the designated grouting point;

step two: lifting a settlement area, specifically including:

step 1: determining a depth range between the reinforced soft foundation and the floor, and designing the drilling curve from the outer construction point of the factory to the inner settlement area of the factory.

step 2: drilling the guiding holes from the outer construction point of the factory, so that the guiding holes lead to the designated location and the designated depth grouting point of the inner settlement area of the factory;

step 3: connecting and communicating the grouting channels from the outer construction point of the factory to the inner grouting point of the factory with each other; and step 4: starting grouting in a rubber bag from the designated grouting point, so that a subsided factory floor is restored to an original floor elevation; and step 5: after the subsided factory floor is restored to the original floor elevation, stopping grouting, and after slurry of the rubber bag is solidified, supplying the slurry to the grouting channels by backward grouting until exiting the grouting channel.

A further embodiment of the present application includes: in the step one, the drilling curve is calculated and designed according to parameters, including specific soil layer condition, underground water condition, and foundation settlement situation from the outer construction point of the factory to the grouting point, angle of drill pipe inserting into soil, and allowable drill pipe radius of curvature. The design of the drilling curve should ensure that there is no disturbance or damage to underground device, and meets used technical parameters, including lowest bend radius of horizontal and directional drill and so on.

A further embodiment of the present application includes: in the step one and two, for drilling a guiding hole, different geological conditions and specific engineering conditions are considered, appropriate drills, drilling tools and drilling method are selected to drill the guiding holes. The selection of the horizontal directional drill depends on engineering requirement, foundation condition and drill size, the monitoring and control can provide a current information for the horizontal directional drill during the drilling, to ensure an accuracy of the guiding hole, and a geomagnetic wired directional control system and a ground beacon system are adopted to perform monitoring and control.

A further embodiment of the present application includes: in the step one and the step two, when connecting and communicating the grouting channels of the grouting points, all drill pipes are withdrawn from the guiding holes, the guiding pipes are detached and replaced with hollow drill pipes having a diameter small than an inner diameter of the guiding hole, a grouting drill is installed at the front of the hollow drill pipe, and the hollow drill pipe and the grouting drill are guided to the grouting point along the guiding hole.

A further embodiment of the present application includes: in the step one, rotating, advancing, and retreating are performed by using the hollow drill pipe driven by a drill power head during grouting, so that grouting is performed at different section points designed in the guiding hole. Rotating, advancing, and retreating are performed by the hollow drill pipe driven by a drill power head during the grouting, by which different section points designed in the guiding holes are performed the grouting.

A further embodiment of the present application includes: in the step two, the drilling curve is calculated and designed according to the parameters, including a depth range of first part grouted soil layer, specific soil layer condition, underground water condition, and foundation settlement situation from the outer construction point of the factory to the grouting point, angle of drill pipe inserting into soil, and allowable drill pipe radius of curvature. The design of the drilling curve should ensure that there is no disturbance or damage to the underground device, and meets the used technical parameters, such as the lowest bend radius of horizontal and directional drill.

A further embodiment of the present application includes: in the step two, after building grouting channels, a rubber bag is injected to the designed grouting point by a hollow drill pipe, and filled with slurry by a grouting pump, while using a floor elevation monitoring system, with an increase of the slurry, the rubber bag starts to squeeze the around soil body, and since the first part soft soil layer had been reinforced, the downward expansion space of the rubber bag is smaller than the upward expansion space of the rubber bag, the upward expansion will lift the floor of the dust-free factory floor, flow velocity of slurry and grouting pressure during grouting are controlled for controlling speed of lifting.

A further embodiment of the present application includes: in the step two, according to an indication from a floor elevation monitoring system, grouting is stopped after the floor is lifted to an original elevation, and, after the slurry is hardened, the backward grouting is performed, in which the aim of the backward grouting is to inject the slurry into the grouting channel, while a real time monitoring is performed by the floor elevation monitoring system, ensuring that there is no protrusion appearing at the floor above the grouting channel due to slurry injection.

The beneficial effects of the present application are as follows:

1. Since the whole integrity of the factory is not destroyed, it can prevent external dust to enter the factory;
2. Since the step two uses the rubber bag for grouting, it improves the use efficiency of the grouting slurry, prevents the grouting slurry from being inefficiently diffused in the foundation soil and further affecting the elevation of the upper floor; and
3. This process increases the construction cost, however, compared with the overall cost of a conventional grouting process and the overall cost of later-period overall factory dust removal, the process is lower in cost and more remarkable in effect.

DETAILED DESCRIPTION

The technical solutions of embodiments in the present application are clearly and completely described in detail below in combination with FIGS. 1-2. Based on embodiments of the present application, all embodiments obtained by those skilled in the art without creative work belong to range of the protection of the present application.

Embodiment 1

Figure 1:
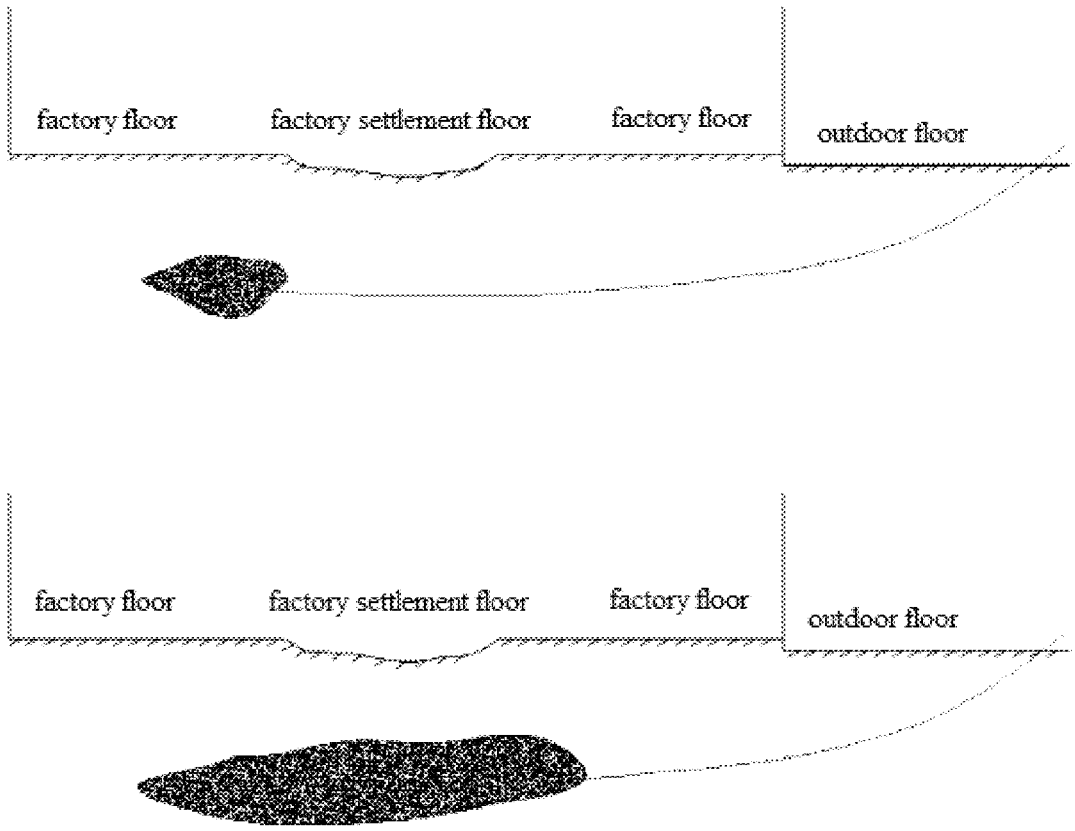
FIG. 1 is a schematic view of a first horizontal grouting of the present application.

Referring to FIG. 1, an accurately and horizontally lifting and reinforcing process for dust-free factory floor includes:

reinforcing a soft foundation, specifically including following steps:

step 1: determining a depth of a soft soil layer in an inner settlement area of the factory, and designing a drilling curve from an outer construction point of the factory to the inner settlement area of the factory;

step 2: drilling a guiding hole from the outer construction point of the factory to a designated location and a designated depth grouting point in the inner settlement area of the factory;

step 3: connecting and communicating grouting channels from the outer construction point of the factory to the inner grouting point of the factory with each other; and step 4: starting grouting from the designated grouting point, which can use backward or forward grouting.

In an embodiment of the present application, the drilling curve is calculated and designed according to the parameters, such as specific soil layer condition, underground water condition, and foundation settlement situation from the outer construction point of the factory to the grouting point, angle of drill pipe inserting into soil, and allowable drill pipe radius of curvature. The design of the drilling curve should ensure that there is no disturbance or damage to underground device, and meets used technical parameters, such as lowest bend radius of horizontal and directional drill. Since the foundation subsidence is caused by that there is the soft soil layer in the foundation of the dust-free factory, the first step of solving the settlement problem is to reinforce the soft soil layer for improving the bearing capacity, thereby supplying a large bearing capacity for the rubber bag to lift the floor and provide an upward reverse force.

In an embodiment of the present application, for drilling a guiding hole, different geological conditions and specific engineering conditions are considered, and appropriate drills, drilling tools and drilling method are selected to drill the guiding hole. The selection of the horizontal directional drill depends on engineering requirement, foundation condition and drill size, the monitoring and control can supply a current time information for the horizontal directional drill during the drilling, to ensure an accuracy of the guiding hole, in which the monitoring and the control can be completed by using geomagnetic wired directional control system and ground beacon system, thereby ensuring that the later-period grouting channel can accurately deliver the slurry to the designed grouting point.

In an embodiment of the present application, when connecting and communicating the grouting channels of the grouting points with each other, all drill pipes are withdrawn from the guiding hole, a guiding drill is detached and replaced with a hollow drill pipe having a diameter small than an inner diameter of the guiding hole. A grouting drill is installed at the front of the hollow drill pipe, and the hollow drill pipe and the grouting drill are guided to the grouting point along the guiding hole.

In an embodiment of the present application, after completing building the grouting channel, a cement paste is prepared according to a certain ratio of the slurry, and grouted to the designed grouting point through the grouting channel by a channel pump. Rotating, advancing, and retreating are performed by the hollow drill pipe driven by a drill power head during the grouting, so that grouting can be performed at different section points preset in the guiding hole.

Embodiment 2

Figure 2:
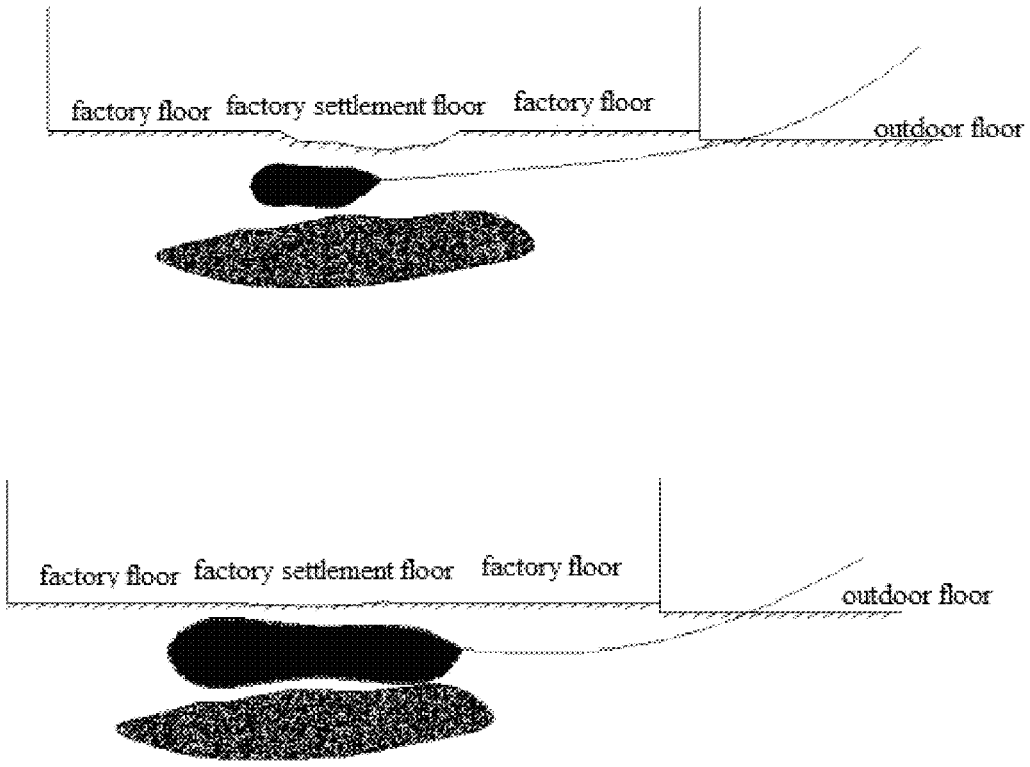
FIG. 2 is a schematic view of a second horizontal grouting of the present application.

Referring to FIG. 2, the lifting and reinforcing process for dust-free factory floor includes:

accurately lifting a settlement area, specifically including:

step 1: determining a depth range between the reinforced soft foundation and the floor, designing the drilling curve from the outer construction point of the factory to the inner settlement area of the factory.

step 2: drilling the guiding holes from the outer construction point of the factory, so that the guiding holes leads to the designated location and the designated depth grouting point of the inner settlement area of the factory;

step 3: connecting and communicating the grouting channels from the outer construction point of the factory to the inner grouting point of the factory with each other; and step 4: starting grouting a rubber bag from the designated grouting point, until a subsided factory floor is restored to an original floor elevation; and step 5: after the subsided factory floor is restored to the original floor elevation, stopping grouting, and after slurry in the rubber bag is solidified, and supplying the slurry to the grouting channels by backward grouting until exiting the grouting channel.

In an embodiment of the present application, for drilling guiding holes, different geological conditions and specific engineering conditions are considered, and appropriate drills, drilling tools and drilling method are selected to drill the guiding holes. The selection of the horizontal directional drill depends on engineering requirement, foundation condition and drill size, the monitoring and control can provide a real time information for the horizontal directional drill during the drilling, to ensure an accuracy of the guiding hole, in which the monitoring and the control can be completed by using geomagnetic wired directional control system and ground beacon system, to ensure the later-period grouting channel can accurately deliver the slurry to designed grouting points.

In an embodiment of the present application, when connecting and communicating the grouting channels of the grouting points, all drill pipes are withdrawn from the guiding holes, the guiding pipes are detached and replaced with hollow drill pipes having a diameter small than an inner diameter of the guiding hole, a grouting drill is installed at the front of the hollow drill pipe, and the hollow drill pipe and the grouting drill are guided to the grouting point along the guiding hole.

In an embodiment of the present application, the drilling curve is calculated and designed according to the parameters, including a depth range of first part grouted soil layer, specific soil layer condition, underground water condition, and foundation settlement situation from the outer construction point of the factory to the grouting point, angle of drill pipe inserting into soil, and allowable drill pipe radius of curvature. The design of the drilling curve should ensure that there is no disturbance or damage to the underground device, and meets the used technical parameters, such as the lowest bend radius of horizontal and directional drill.

In an embodiment of the present application, after building grouting channels, a rubber bag is injected to the designed grouting point by a hollow drill pipe, and filled with slurry by a grouting pump, while using a floor elevation monitoring system, with an increase of the slurry, the rubber bag starts to squeeze the around soil body, and since the first part soft soil layer had been reinforced, the downward expansion space of the rubber bag is smaller than the upward expansion space of the rubber bag, the upward expansion will lift the floor of the dust-free factory floor, flow velocity of slurry and grouting pressure during grouting are controlled for controlling speed of lifting.

In an embodiment of the present application, according to an indication from a floor elevation monitoring system, grouting is stopped after the floor is lifted to an original elevation, and, after the slurry is hardened, the backward grouting is performed, in which the aim of the backward grouting is to inject the slurry into the grouting channel, while a real time monitoring is performed by the floor elevation monitoring system, ensuring that there is no protrusion appearing at the floor above the grouting channel due to slurry injection.

The principle of an embodiment is as follows: the soft soil foundation is reinforced by the first part; and the settlement range is accurately lifted by the second part, since the whole integrity of the factory is not destroyed, it can prevent the external dust to enter the factory, and the step two uses the rubber bag for grouting, which improves the use efficiency of the grouting fluid, prevents the slurry from being inefficiently diffused in the foundation soil and further affecting the lifting of the upper floor.

For those skilled in the art, the present application is not obviously limited in above detail of the exemplary embodiments, and can be realized by other specific forms without deviating from the spirit and basic features of the present application. Therefore, from any aspects, it should regard embodiments as exemplary and unlimited, and the range of the present application is limited by the attached claims but not the above specification. Therefore, all changes falling within meaning and range of equivalent components in the claims are included in the present application. It should not regard any drawing marks of the claims as a limitation for the relative claims.

Besides, it should be understood that, the specification is described by embodiments, however, each embodiment is not only included an independent solution, this description of the specification is just made for clear, the skill in the art should regard the specification as a whole, and the solution of each embodiment can be adaptively combined to form other embodiment understood by the skill in the art.

What is claimed is:

1. A lifting and reinforcing process for a dust-free factory floor, comprising:

step one, reinforcing a foundation, comprising following steps:

step 1: determining a depth of a soil layer in an inner settlement area of a factory, and designing a drilling curve from an outer construction point of the factory to the inner settlement area of the factory;

step 2: drilling guiding holes from the outer construction point of the factory, so that the guiding holes lead to a designated location and a designated depth grouting point of the inner settlement area of the factory;

step 3: connecting and communicating grouting channels from the outer construction point of the factory to an inner grouting point of the factory with each other; and step 4: starting grouting from the designated depth grouting point to yield a reinforced foundation;

step two: lifting a settlement area, comprising:

step 1: determining a depth range between the reinforced foundation and a floor of the factory, and designing the drilling curve from the outer construction point of the factory to the inner settlement area of the factory;

step 2: drilling the guiding holes from the outer construction point of the factory, so that the guiding holes lead to the designated location and the designated depth grouting point of the inner settlement area of the factory;

step 3: connecting and communicating the grouting channels from the outer construction point of the factory to the inner grouting point of the factory with each other;

step 4: starting grouting from the designated depth grouting point, so that a subsided factory floor is restored to an original floor elevation; and step 5: after the subsided factory floor is restored to the original floor elevation, stopping grouting, and after slurry is solidified, supplying the slurry to the grouting channels by backward grouting until exiting the grouting channels.

2. The lifting and reinforcing process for dust-free factory floor according to claim 1, wherein, in the step one, the drilling curve is calculated and designed according to parameters, the parameters comprising soil layer condition, underground water condition, and foundation settlement situation from the outer construction point of the factory to the inner grouting point, angle of drill pipe being inserted into soil, and allowable drill pipe radius of curvature.

3. The lifting and reinforcing process for dust-free factory floor according to claim 1, wherein, in the step one and the step two, a geomagnetic wired directional control system and a ground beacon system are adopted to perform monitoring and control.

4. The lifting and reinforcing process for dust-free factory floor according to claim 1, wherein, in the step one and the step two, when connecting and communicating the grouting channels of the channels from the outer construction point of the factory to the inner grouting point, all drill pipes are withdrawn from the guiding holes, guiding pipes are detached and replaced with hollow drill pipes having a diameter small than an inner diameter of the guiding holes, a grouting drill is installed at a front of the hollow drill pipes, and the hollow drill pipes and the grouting drill are guided to the inner grouting point along the guiding holes.

5. The lifting and reinforcing process for dust-free factory floor according to claim 1, wherein, in the step one, rotating, advancing, and retreating are performed by using a hollow drill pipe driven by a drill power head during grouting, so that grouting is performed at different section points designed in the guiding holes.

6. The lifting and reinforcing process for dust-free factory floor according to claim 1, wherein, in the step two, the drilling curve is calculated and designed according to parameters, the parameters comprising a depth range of first part grouted soil layer, soil layer condition, underground water condition, and foundation settlement situation from the outer construction point of the factory to the inner grouting point, angle of drill pipe being inserted into soil, and allowable drill pipe radius of curvature.

7. The lifting and reinforcing process for dust-free factory floor according to claim 1, wherein, in the step two, after building the grouting channels, a rubber bag is injected to the designed depth grouting point by a hollow drill pipe, and filled with the slurry by a grouting pump, while flow velocity of the slurry and grouting pressure during grouting are controlled by using a floor elevation monitoring system for controlling speed of lifting.

8. The lifting and reinforcing process for dust-free factory floor according to claim 1, wherein, in the step two, according to an indication from a floor elevation monitoring system, grouting is stopped after the floor is lifted to the original floor elevation, and, after the slurry is hardened, the backward grouting is performed, while real time monitoring is performed by the floor elevation monitoring system, ensuring that there is no protrusion appearing at the floor above the grouting channels due to slurry injection.

* * * * *